United States Patent [19]

Scholl

[11] 4,446,802

[45] May 8, 1984

[54] AUTOMATIC SEWING MACHINES

[75] Inventor: Hans Scholl, Oerlinghausen-Lipperreihe, Fed. Rep. of Germany

[73] Assignee: Kochs Adler AG, Fed. Rep. of Germany

[21] Appl. No.: 506,432

[22] Filed: Jun. 21, 1983

[30] Foreign Application Priority Data

Jul. 5, 1982 [DE] Fed. Rep. of Germany ..... 3225046

[51] Int. Cl.[3] ..... D05B 21/00; D05B 55/14

[52] U.S. Cl. ..... 112/121.12; 112/220; 112/221; 112/303

[58] Field of Search ..... 112/121.12, 121.15, 112/121.11, 121.29, 303, 321, 221, 220, 86, 90, 118

[56] References Cited

U.S. PATENT DOCUMENTS 159,006 1/1875 Williamson ..... 112/221 X 444,758 1/1891 Leslie ..... 112/221 X

*Primary Examiner*—H. Hampton Hunter

*Attorney, Agent, or Firm*—Laff, Whitesel, Conte & Saret

[57] ABSTRACT

An automatic sewing machine is provided with a workpiece feeding device for imparting a continuous motion to the workpiece during the sewing cycle and with a sewing head having a needle bar which is oscillatorily driven by an arm shaft via a crank gear. In order to reduce the needle deflection due to the continuous workpiece feed motion in a simple way, in addition to the crank gear for driving the needle bar, there is interposed a double crank gear between the arm shaft and the crank gear which reduces the angle of rotation while the needle penetrates the workpiece.

3 Claims, 5 Drawing Figures

Fig.1
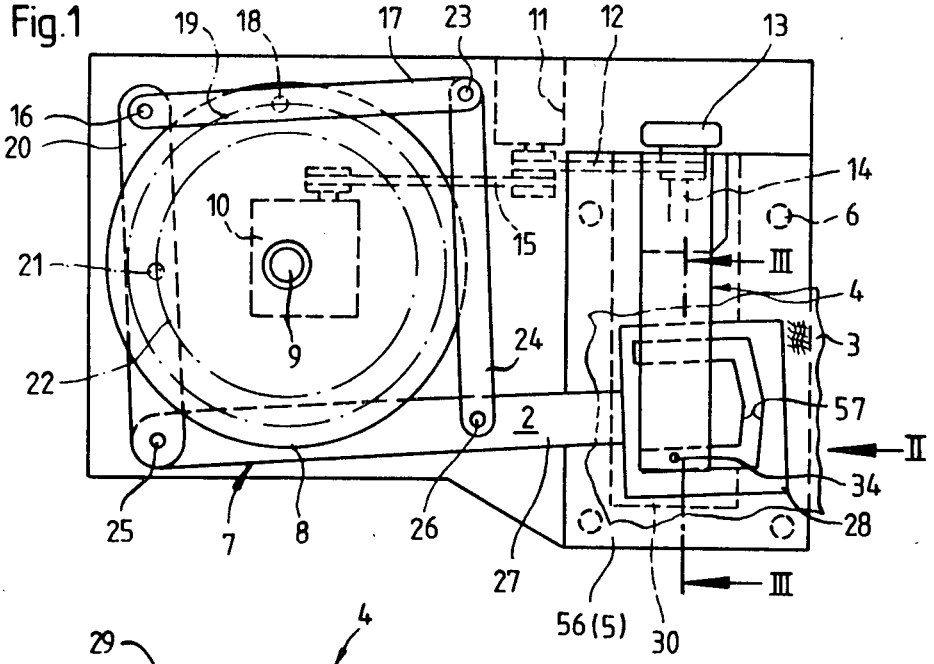
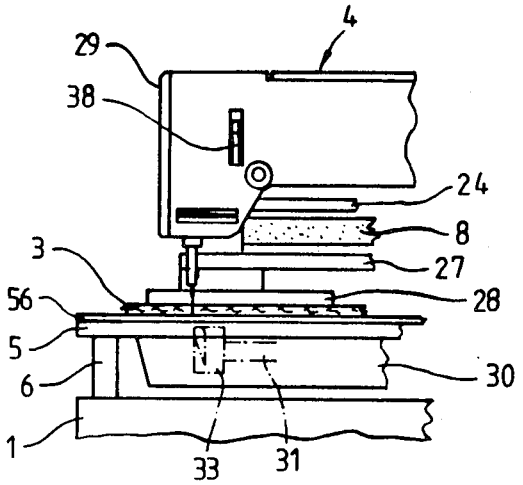
Fig. 2
Fig. 5
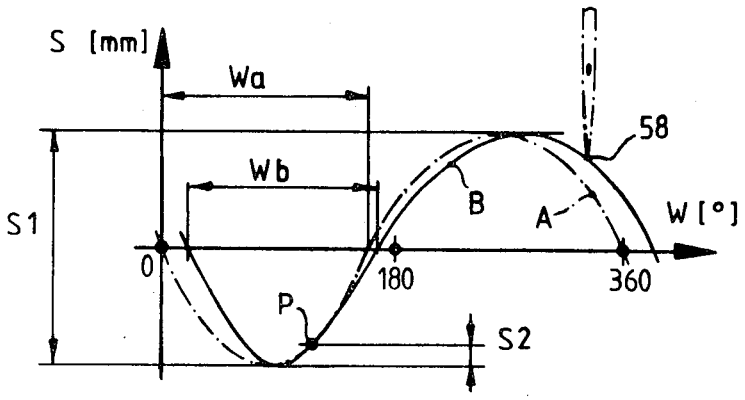

AUTOMATIC SEWING MACHINES

BACKGROUND OF THE INVENTION

This invention relates to an automatic sewing machine having a feeding device for imparting a continuous movement to a workpiece during the sewing process and a sewing head including a needle bar arranged to be driven in oscillatory manner by an arm shaft by means of a gear drive.

Such sewing machines, known e.g. from U.S. Pat. No. 4,157,686, have feeding devices comprising a linkage system formed by a four-bar linkage, whose two guide levers associated with a fixed fulcrum in each case engage by means of a guide roller or the like in in each case one control groove on the top or bottom of the control disc. Thus, on rotating the control disc, the workpiece holder connected to the off-drive lever is guided in a plane along a two-dimensional groove predetermined by the course of the two control grooves. Such feeding devices have proved to be extremely satisfactory in practice, because they are constructionally simple and can be easily supervised and because for producing a different seam configuration, i.e. for producing a different movement of the workpiece holder, it is merely necessary to use a control disc with different control grooves. However, a problem of such sewing machines is that the workpiece is also moved during the insertion of the needle, so that a so-called needle deflection is produced, which can lead to collisions between the needle and the hook tip and even to the needle breaking.

In the case of the automatic sewing machine known from German Patent Specification No. 2733397, for reducing this problem, an additional gear with a further driving arrangement is positioned upstream of the feeding device and as a result the movement of the sewing material holder during the insertion of the needle is reduced. However, such a design is constructionally complicated. As a result of the oscillatory drive of the feeding device, humming occurs at least occasionally and also the gear must be constructed free from play.

U.S. Pat. No. 480298 discloses an eccentric gear drive for the needle bar of a sewing machine, by means of which the needle is accelerated in the lower area. The object of this measure is to gain time in order to be able to correctly operate the recpetion mechanism and the sewing material transport.

SUMMARY OF THE INVENTION

The object of the invention is to so construct an automatic sewing machine of the aforementioned type, that the deflection of the needle can be reduced through constructionally simple measures.

Accordingly, the present invention provides an automatic sewing machine having a feeding device for imparting a continuous movement to a workpiece during the sewing process, a sewing head including a needle bar arranged to be driven in oscillatory manner by an arm shaft by means of a gear drive, and a mechanism for reducing the deflection of the needle during the insertion of the latter into the workpiece, said mechanism comprising a bouble gear drive connected between the arm shaft and the gear drive for the needle bar and adapted to reduce the angle of rotation during which the needle is inserted into a workpiece.

Diverging from the known solutions, in the present invention the insertion time of the needle is reduced and consequently so is the path which must be covered by the sewing material during the needle insertion time. Experience has shown that the needle deflection can be reduced by 20 to 28%. If the hitherto permitted deflection of the needle can be accepted, it is possible by means of the measures according to the invention to achieve greater stitch lengths. Such double gear drives are known from Rauh/Hagedorn "Praktische Getriebelehre", 3rd edition, Vol. 1, die Viergelenkkette, Springer-Verlag, pp.36 to 39. The material feed according to the invention can be completely uniform, as well as continuous. In order to be able to drive the thread lever by means of the arm shaft in a normal manner the double gear drive is preferably arranged in a separate shaft system, formed by an intermediate shaft and a shaft, arranged parallel to the arm shaft and displaced with respect thereto, the intermediate shaft being arranged to be driven by the arm shaft. Thus, the basic concept of the sewing head can be retained unchanged and only a few additional measures are required.

The double gear drive is desirably arranged adjacent the said needle bar. This arrangement ensures that the masses to be accelerated in oscillatory manner are as small as possible. The shaft located between the gear drive of the needle bar and the double gear drives, parts of the double gear drive and the needle bar gear drive are driven in oscillatory manner, i.e. in a non-uniform, rotary manner.

BRIEF DESCRIPTION OF THE DRAWINGS

The invention will now be further described, by way of example, with reference to the drawings, in which:

FIG. 1 is a plan view of one embodiment of an automatic sewing machine according to the invention;

FIG. 2 is a partial front view of the automatic sewing machine in the direction of the arrow II in FIG. 1;

FIG. 5 is a diagrammatic representation of the stroke and the angle of rotation of the needle.

DESCRIPTION OF THE PREFERRED EMBODIMENT

Figure 3:
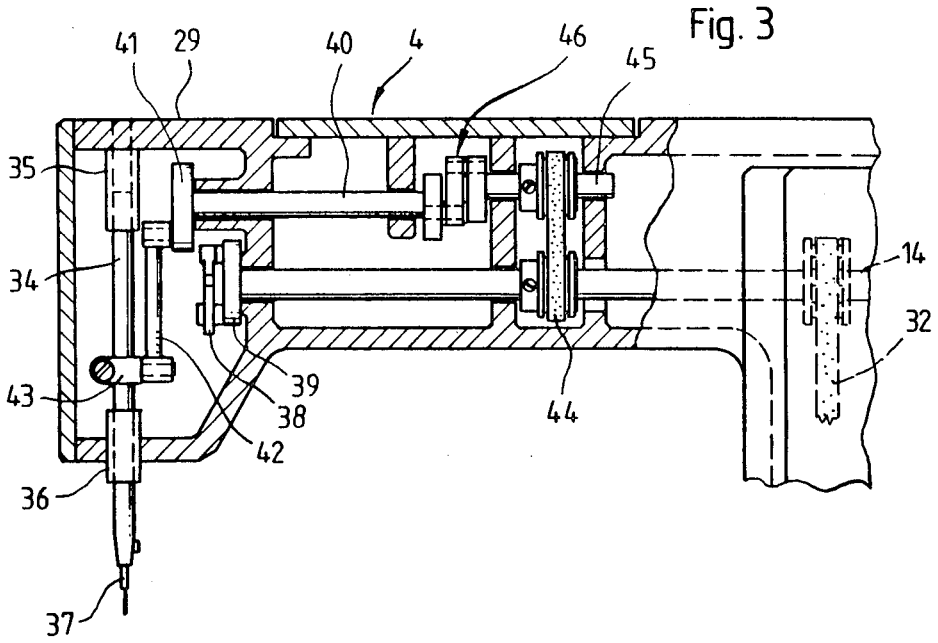
FIG. 3 is a vertical section of the upper arm of the sewing machine taken along the line III—III in FIG. 1.

The automatic sewing machine according to the drawings includes a stand 1 carrying a workpiece feeding device 2 for a workpiece 3 and a sewing head 4. The sewing head 4 is mounted on a plate 5 which is supported with respect to the stand 1 by means of posts 6.

The feeding device 2 is provided with a linkage system 7, which in principle consists of a parallelogram linkage and co-operates with a control disc 8. The control disc 8 is secured to an off-drive-shaft 9 of a gear 10 mounted on the stand 1. The control disc 8 is driven via the gear 10 by a drive motor 11 of the automatic sewing machine situated inside the stand 1. The motor 11 drives, via a belt drive 12, an arm shaft 14 of the sewing head 4 provided at its outer surface with a handwheel 13. A further belt drive 15 establishes a driving connection with the gear 10.

The linkage system 7 is provided with a fixed fulcrum formed by an axis 16, which is secured to the stand 1. A guide lever 17 is pivotally supported at the axis 16 and is arranged above the control disc 8 parallel to the main direction of the sewing head 4. This guide lever 17 is provided with a guide roller 18 engaging a control groove 19 formed in the upper surface of the control disc 8. An intermediate lever 24 is pivotally connected to the end of the guide lever 17 remote from the axis 16 by a pivot pin 23. The intermediate lever 24 is arranged above the control disc 8 and is pivotally connected at its other end to an off-drive lever 27 by a pivot pin 26. One end of a guide lever 20 is pivotally mounted at the axis 16 and extends parallel to the intermediate lever to the off-drive lever 27 to which it is pivotally connected by a pivot pin 25. The off-drive lever 27 extends parallel to the guide lever 17 in a plane beneath the control disc 8. The guide lever 20 is provided, intermediate its ends, with guide roller 21 which engages in a control groove 22 formed in the upper surface of the control disc 8. As will be clear from FIG. 1, the linkage system 7 defined by the four joints 16, 23, 25, 26, is a parallelogram-link-system having nearly right angles and equal shanks. To the off-drive lever 27 there is connected a workpiece supporting plate 28 for the workpiece 3. The automatic sewing machine described thus far is known in principle and is used in the trade and known, for example, from German Offenlegungsschrift No. 30 00 831(U.S. Pat. No. 4,347,797).

A hook shaft 31 located in a lower arm 30 is driven via a belt drive 32 by the arm shaft 14, which is supported in the upper arm 29 of the sewing head 4. The lower arm is formed below the plate 5. At the end of the hook shaft 31 there is mounted in usual manner a hook 33. The belt drive 32 branches from the arm shaft 14 close to the handwheel 13.

In the area of the free end of the upper arm 29 there is arranged a needle bar 34 which is axially displaceably supported in two aligned bearings 35, 36. The lower free end of the needle bar 34 carries a needle 37.

Adjacent the needle bar 34 there is arranged a thread lever 38, which is driven by the arm shaft 14. For this reason, to the free end of the arm shaft 14 there is secured a crank 39 imparting to the thread lever 38 an up and down motion at each complete revolution of the arm shaft 14.

The needle bar 34 is driven by a shaft 40 supported in the upper arm 29 and arranged parallel to and above the arm shaft 14. To the free end of the shaft 40 adjacent the needle bar 34 there is fastened a crank 41, which is connected via a link rod 42 to a needle bar connecting collar 43. The needle bar connecting collar 43 is clamped to the needle bar 34 and is adjustable in height. Aside from the fact that the shaft 40 with respect to the arm shaft 14 is a special one, this kind of drive for the needle bar 34 is inexpensive.

The drive of the shaft 40 and the needle bar 34 is performed by means of a belt drive 44 mounted on the arm shaft 14 via an intermediate shaft 45 and a double crank gear 46 located between the intermediate shaft 45 and the shaft 40. The double crank gear 46 is provided with a first crank 47 secured to the intermediate shaft 45 and a second crank 48 secured to the shaft 40. To the crank 47 in parallel with, but eccentric to, the intermediate shaft 45 there is mounted a crank pin 49 by means of a disc 50, while to the crank 48 and also in parallel with, but eccentric to, the shaft 40 there is mounted a further crank-pin 51 by means of a disc 52. The two crank pins 49, 51 are connected by a connecting rod 53 formed with bores 54, 55 for receiving the respective crank pins 49, 51. As can be seen from FIGS. 3 and 4, the intermediate shaft 45 and the shaft 40 are also in reverse order and have—with respect to the double crank gear 46—an eccentricity E. Furthermore, the double crank gear 46 is arranged as close as possible to the needle bar 34 as to keep the masses to be forced as small as possible.

While sewing, the workpiece supporting plate 38 carrying the workpiece 3 is moved upon a cover plate 56 which is arranged on the plate 5. When actuating the sewing head 4 by the drive motor 11, simultaneously a continuous rotary motion with a constant angle velocity is imparted to the control disc 8. Owing to the configuration of the control grooves 19, 22, the workpiece supporting plate 28 is continuously moved relative to the needle 37 and to a recess 57 formed in the workpiece supporting plate 28 according to the desired seam contour.

In FIG. 5 there is illustrated the stroke S of the needle point 58 above the angle of rotation W of the arm shaft 14. The dot-dash lined curve A represents the stroke-/angle of rotation-function of a conventional needle bar drive by means of the crank connected to the arm shaft, while the curve B drawn in full line represents the stroke/angle of rotation-function of a needle bar drive according to the invention.

The abscissa is located at the level of the cover plate 56, so that the courses of the curves below the abscissa represent the time spaces during the penetration of the needle 37, while the courses of the curves above the abscissa represent the time spaces in which the needle 37 does not penetrate the workpiece 3. The moment at which the hook point 33 is located approximately above the needle eye for loop seizing, is denoted with P.

As, in conjunction with a needle bar drive of the described kind, the needle 37, owing to the angle of rotation Wa, is positioned below the cover plate 56, the corresponding angle of rotation Wb in conjunction with a drive by means of a double crank gear is smaller, as the needle movement is retarded above the cover plate and accelerated below the cover plate 56.

In order to obtain also in conjunction with the embodiment according to the invention an identical position of the hook point relative to the needle eye, the two curves A and B are displaced in the direction of the abscissa as to make contact at the point P.

The abridged time of penetration relates to a proportionally abridged path of the workpiece supporting plate 28. Vice versa, taking into consideration the allowable needle movement as usual in conjunction with needle bar drives, an inversely proportional enlargement of the stitch length is rendered possible. The graph shows needle movement reduced by 20 to 28% and corresponding enlargements of the stitch length, respectively.

Figure 4:
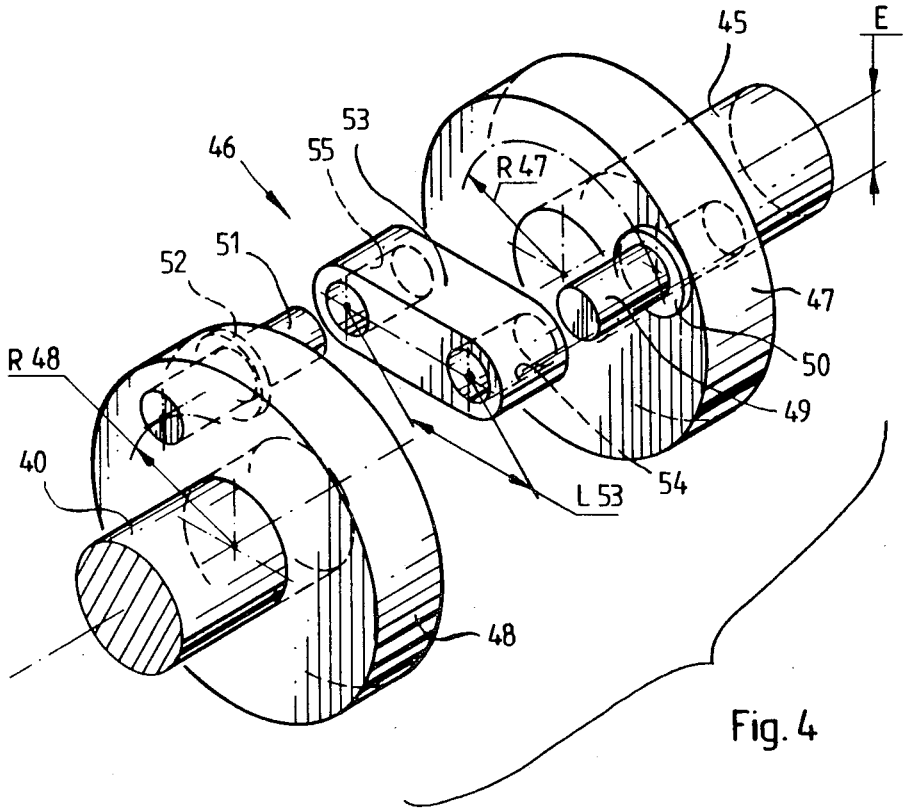
FIG. 4 is an exploded perspective view of a double crank gear.

In addition to the eccentricity E, the distance between the axes of the intermediate shaft 45 and the crank pin 49 is shown in FIG. 4 as the radius R47, and the distance between the axis of the shaft 45 and the axis of the crank pin 51 is shown as the radius R48. The distance between the axis of the crank pins 49 and 51 is shown as the length L53 which is substantially equal to the distance between the axes of the bores 54, 55 of the connecting rod 53.

An optimal reduction of the needle movement by 28% was obtained in conjunction with the following relative sizes:

R47'/E 3.3
R48'/E 2.0
L53/E 3.0

In this case the eccentricity was rated for E=6.5 mm

The invention is not restricted to the above-described embodiment but modifications and variations may be made without departing from the spirit and scope of the invention as defined by the appended claims.

What is claimed is:

1. An automatic sewing machine having a feeding device for imparting a continuous movement to a workpiece during the sewing process, a sewing head including a needle bar arranged to be driven in oscillatory manner by an arm shaft by means of a gear drive, and a mechanism for reducing the deflection of the needle during the insertion of the latter into the workpiece, said mechanism comprising a double gear drive connected between the arm shaft and the gear drive for the needle bar and adapted to reduce the angle of rotation during which the needle is inserted into a workpiece.

2. An automatic sewing machine as claimed in claim 1, in which the double gear drive is arranged in a separate shaft system, formed by an intermediate shaft and a shaft, arranged parallel to the arm shaft and displaced with respect thereto, the intermediate shaft being arranged to be driven by the arm shaft.

3. An automatic sewing machine as claimed in claim 1, in which the double gear drive is arranged adjacent said needle bar.

* * * * *